US005377855A

United States Patent [19]

Cook, Jr. et al.

[11] Patent Number: 5,377,855

[45] Date of Patent: Jan. 3, 1995

[54] TRAY FOR FREEZING SEAFOOD

[75] Inventors: Harold T. Cook, Jr., Bainbridge Island; Mimi S. Fielding, Gig Harbor; Donn B. Furlong, Bellevue, all of Wash.

[73] Assignee: Marco Seattle, Inc., Seattle, Wash.

[21] Appl. No.: 713,132

[22] Filed: Jun. 10, 1991

[51] Int. Cl.[6] ..... B65D 1/36

[52] U.S. Cl. ..... 220/4.23; 206/564; 229/407; 220/555; 426/119; 426/129; 426/393

[58] Field of Search ..... 426/119, 129, 393, 524; 206/562–564; 229/2.5 R; 220/555, 4.22, 4.23

[56] References Cited

U.S. PATENT DOCUMENTS

| | | | |
|---|---|---|---|
| 1,773,080 | 8/1930 | Birdseye | 426/129 |
| 1,977,373 | 10/1934 | Birdseye | 426/393 |
| 2,858,224 | 10/1958 | Darrah | 426/119 |
| 2,920,968 | 1/1960 | Grandy | 426/129 |
| 3,040,923 | 6/1962 | Leitzel | 229/2.5 |
| 3,152,915 | 10/1964 | Cover et al. | 426/393 |
| 3,197,058 | 7/1965 | Hale | 426/119 |
| 3,464,618 | 9/1969 | Martelli et al. | 229/2.5 |
| 3,490,576 | 1/1970 | Alessi et al. | 426/129 |
| 3,501,080 | 3/1970 | Govatsos | 229/2.5 |
| 3,565,321 | 2/1971 | Weiss | 229/2.5 |
| 3,671,272 | 6/1972 | Mixon | 426/129 |
| 3,896,239 | 7/1975 | Peters | 426/119 |
| 3,926,363 | 12/1975 | Catron | 229/2.5 |
| 3,982,655 | 9/1976 | Kaupert | 229/2.5 |
| 4,009,817 | 3/1977 | Marshall et al. | 229/2.5 |
| 4,517,206 | 5/1985 | Murphy et al. | 426/119 |
| 4,522,301 | 6/1985 | Ajmera | 426/119 |
| 4,728,521 | 3/1988 | Mitchell | 426/119 |
| 4,899,881 | 2/1990 | Girard et al. | 426/119 |
| 5,005,703 | 4/1991 | Bodker | 206/563 |
| 5,085,879 | 2/1992 | Elbaz | 426/129 |

FOREIGN PATENT DOCUMENTS

| | | |
|---|---|---|
| 133517 | 4/1964 | New Zealand . |
| 198647 | 9/1983 | New Zealand . |
| 221348 | 4/1990 | New Zealand . |

*Primary Examiner*—Steven Weinstein
*Attorney, Agent, or Firm*—Christensen, O'Connor, Johnson & Kindness

[57] ABSTRACT

A tray (10) for receiving a plurality of fish fillets (28) in a layer for compaction and freezing in a stack of layers. The tray is formed from a sheet (18) of material having a first portion (12) joined to a second portion (14) by a flexible hinge portion (16). The first portion is formed to define a plurality of first recesses (24) and the second portion is formed to define a plurality of negative second recesses (26). A fillet is received within each of the first recesses to form a layer, the tray is folded, and an additional layer of fillets is received within the second recesses. The tray is constructed and configured to be deformed and to enable the fillets to deform within the recesses, under the force of compaction, to form separable layers of substantially separate frozen fillets.

12 Claims, 3 Drawing Sheets

Fig. 4.
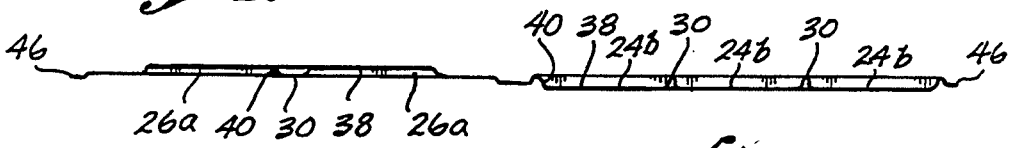
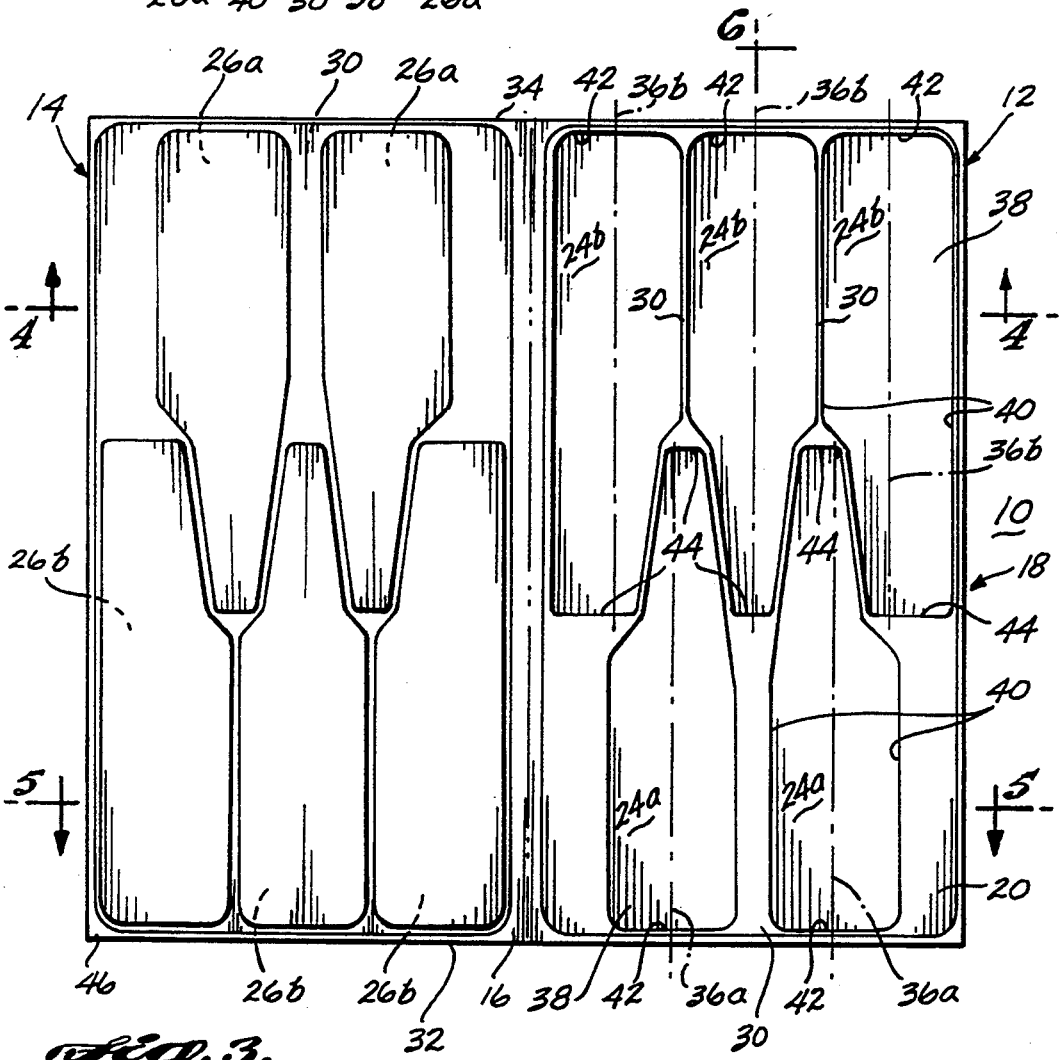
Fig. 3.
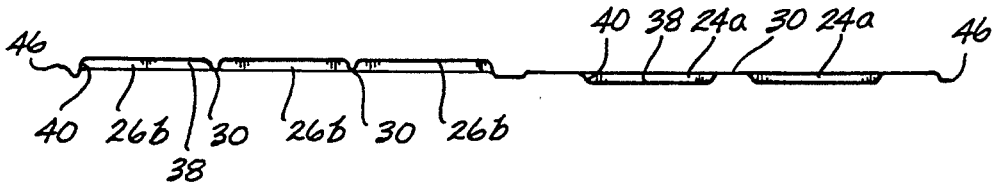
Fig. 5.

TRAY FOR FREEZING SEAFOOD

TECHNICAL FIELD OF THE INVENTION

The present invention relates to the processing of seafood, more particularly to the packaging of frozen fish fillets, and even more particularly to a tray and method for freezing separate fillets in compacted, separable layers.

BACKGROUND OF THE INVENTION

Various processes have been developed for freezing seafood to maintain the quality of the seafood from the time it is harvested until the time it is prepared for eating. In particular, processes have been developed for rapidly freezing large volumes of fish fillets to retain the product freshness until further processing and cooking by prepared food manufacturers or restaurants.

The most preferred conventional process for producing high quality frozen fillets involves individual quick freezing of the fillets. Fillets are placed on a conveyor that goes through a blast freezer or freezing tunnel to freeze each fillet individually and separate from the other fillets. The fillets are then individually glazed with water or a sugar water solution to inhibit dehydration, and placed in cold storage. Because of the individual processing, the fillets retain their shape and are not subject to breakage. Further, the fillets may later be individually thawed on an as-needed basis by purchasers of the fillets. However, a drawback of this method is the expense and processing limitations associated with individually handling the fillets. Additionally, individually frozen fillets must be stored loosely due to their irregular shapes, with significant voids existing between the fillets. Since much fish processing and freezing is done on board ships, the storage required for the individually frozen fillets is a significant limiting factor. As the frozen fillets are not individually supported in storage, they are subject to breakage and curling.

Several conventional processes have thus been developed for batch-wise freezing of fillets in paperboard cartons. In each of these processes, the cartons are placed in metal pans and slid between horizontal plates, or shelves, of large capacity plate freezers. The shelves are then drawn together to compress and compact the fillets within the cartons, as constrained by the metal pans. The compacted fish fillets are then frozen within the carton by means of refrigerant circulated through the shelves.

The most inexpensive batch-wise, plate freezing method involves filling the paperboard carton with fillets placed randomly therein. During compaction prior to freezing, the fillets are deformed and slide relative to each other within the box to fill any significant air pockets between the fillets. The result of this process is a frozen block in which the fillets are closely intermingled and frozen to each other. Individual fillets cannot be separated from the frozen block without thawing the block, which can result in partial spoilage of the fish near the outer surface of the block prior to thawing of the fish within the interior of the block. It is also difficult to remove the fillets, once thawed, from the block without breakage into smaller pieces. Thus, most often the frozen block is instead sawed into strips or smaller block forms that are then coated with a breeding and fried, since it is not as important to retain the original shape of the fillet for such preparation methods.

An improved batch-wise, plate freezing method has been developed, wherein the fish are frozen in convoluted layers within a carton. This process, commonly referred to as "shatter pack," involves the placement of layers of fish fillets within a carton between sheets of plastic film prior to freezing. Separate sheets of film may be placed between the layers, or alternately a single elongated strip of film can be positioned in an alternating fashion into the box with intermediate layers of fish interposed between. The method is extremely cumbersome due to difficulty in controlling the plastic film during filling the carton. The plastic film is extremely flimsy, and tends to stick to the wet fillets, itself, the processors' hands and equipment, making proper placement of the film difficult.

After freezing in this manner, the layers of fillets can be separated by impacting or jarring the block on a hard surface, shattering the frozen bond lines between the convoluted layers along the plastic film. This method represents an improvement over block frozen fillets, in that it is possible to remove a layer of fillets without thawing the entire block. However, air is introduced between the remaining shattered apart layers, resulting in partial dehydration of the fish during subsequent storage after shattering. Additionally, individual fillets within each layer slide and move over each other during compaction of the layers in the plate freezer. The individual fillets thus contact and overlap each other, and the frozen bonds formed between individual fillets are often stronger than the fillets themselves. Thus during jarring the shatter-packed carton and subsequent attempts to separate the fillets within a layer, many fillets are often broken. Additionally, the plastic film is difficult to remove from crevices formed between the fillets, and must be picked out during cooking of the fillets.

A still further variation on the plate freezing involves the formation of elongated "logs" of fillets by placing fillets in a row on an elongated strip of plastic. The fillets and plastic are then rolled into a solid log, and a plurality of logs are placed parallel to each other in a row within the carton prior to compaction and freezing. The tubular logs are compressed and deformed during freezing, resulting in intimate bonding of the individual fillets within each log to each other. The product produced by this process is typically used for preparing fish sticks, which can be cut or extruded out of individual logs. Otherwise, the entire frozen log must be thawed to remove individual fillets due to the intimate bonding of the fillets within each log.

SUMMARY OF THE INVENTION

The present invention provides a tray for receiving a plurality of seafood pieces in a layer for compaction and freezing with a stack of adjacent layers of seafood pieces. The tray is formed from a sheet of material that defines a plurality of first recesses, each recess capable of receiving a piece of seafood to form a layer of individual, separated seafood pieces. The sheet is constructed and configured to be deformed when the layer received therein is compacted with adjacent layers of seafood pieces, enabling the seafood pieces in the layer to deform under the force of compaction within the first recesses to form a separable frozen layer of substantially separate, individual seafood pieces.

In a further aspect of the present invention, the tray is formed to define a first portion and a second portion joined by a flexible hinge portion. A plurality of first recesses are formed in the first portion, and a plurality of negative second recesses are formed in the second portion. The tray is foldable along the flexible hinge portion to overlaps the second portion over the first portion, so that first and second recesses open in the same direction. Pieces of seafood are received within the first and second recesses to form first and second layers of seafood, respectively.

The tray enables production of a frozen stack of separable layers of seafood, such as fish fillets, within a carton using a plate freezer. Each fillet is substantially surrounded, or encased, by the tray in which it is received and the overlaying tray or carton, and thus is protected from dehydration and contact by other fillets. Thus the fillets are nearly as protected as individually glazed, frozen fillets, without the expense of the extra glazing step. Individual trays and frozen layers formed therefrom can later be peeled from the stack without the necessity of thawing or separating the remaining layers. The remainder of the frozen stack can thus be restored until needed, without the introduction of air between the layers or spoilage of partially thawed fillets. Within each layer, the individual seafood pieces may be removed from the tray one by one as needed without breakage.

A further aspect of the present invention involves a method for freezing individual pieces of seafood into a stack of separable layers. A plurality of layers of seafood pieces on trays are stacked within a frame, with each layer including a plurality of separate seafood pieces that are received in corresponding recesses formed in the tray. The stack is then compressed to deform the trays and compact the layers, while maintaining the individual seafood pieces within each layer separate within the recesses, followed by freezing.

The method of the present invention has the majority of the benefits associated with individual quick frozen processing, but is much more economical as the fillets need not be handled individually after introduction into cartons prior to compacting. Further, the closely packed frozen product contains minimum voids, and takes up significantly less storage room than individual quick frozen products, thus being well suited for on-board ship processing plants.

BRIEF DESCRIPTION OF THE DRAWINGS

FIG. 3 is a plan view of the open tray of FIG. 1;

FIG. 4 is a cross-sectional view of the tray of FIG. 3 taken substantially along the line 4—4;

FIG. 5 is a cross-sectional view of the open tray of FIG. 3 taken substantially along the line 5—5;

DETAILED DESCRIPTION OF THE PREFERRED EMBODIMENT

Figure 1:
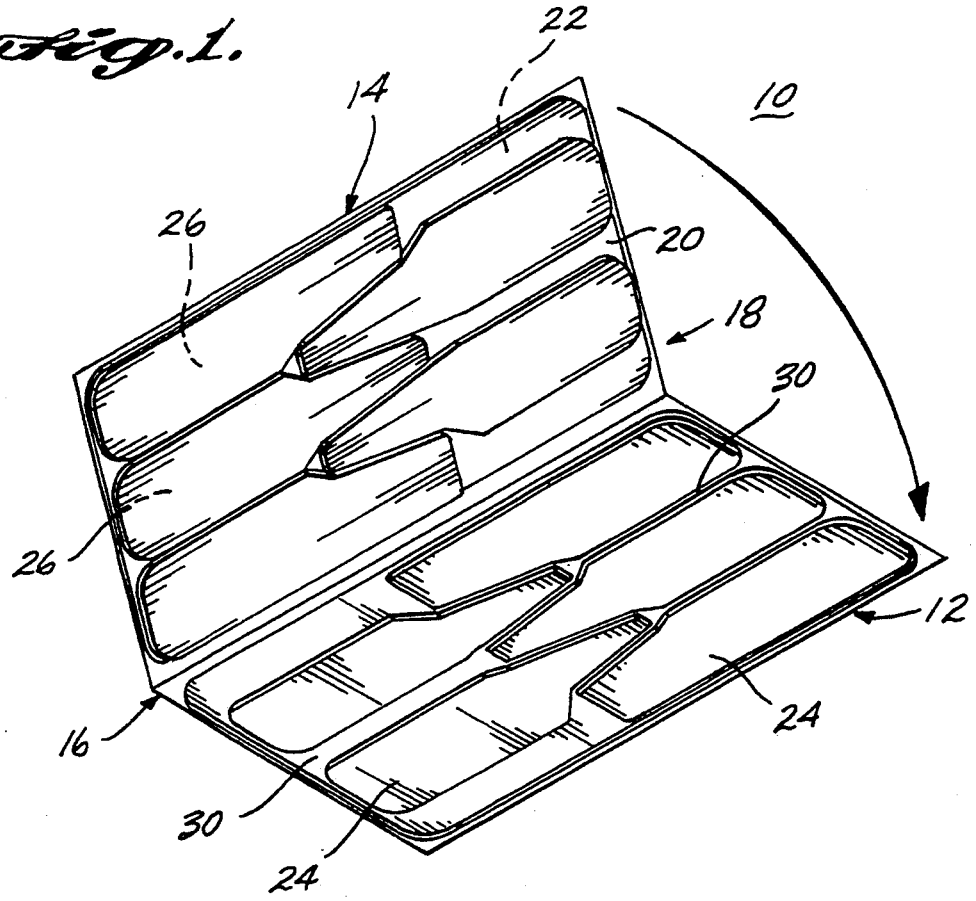
FIG. 1 is a pictorial view of a preferred embodiment of a foldable tray constructed in accordance with the present invention, with a second portion of the tray shown folded partially over the first portion.

A tray 10 constructed in accordance with the present invention is illustrated in FIG. 1. The tray 10 includes a first portion 12 joined to a second portion 14 by a flexible hinge portion 16. The tray 10 is formed from a sheet 18 of material having an upper surface 20 and an opposing lower surface 22. A plurality of elongated first recesses 24 are formed in the first portion 12 of the tray 10. The first recesses 24 are concave as viewed from the upper surface 20 of the sheet 18. A plurality of elongated second recesses 26 are formed in the second portion 14 of the tray 10. The second recesses are negatives of the contour of the first recesses 24, and thus are convex as viewed from the upper surface 20 of the sheet 18, and concave as viewed from the lower surface 22 of the sheet 18. The tray 10 is foldable along the hinge portion 16 so that the second portion 14 overlies the first portion 12, in which folded position both the first recesses 24 and second recesses 26 open upwardly in the same direction.

The tray 10 is intended for use in freezing pieces or segments of seafood, and is particularly well suited for freezing layers of individual fillets of fish such as cod, pollock and other species. The layers are frozen and compacted in conventional plate freezers to produce separable layers of frozen fish, each layer including separate individual fillets. Boneless fillets of fish are capable of limited deformation, without tearing apart, when compressed during compaction and freezing; thus the fillets tend to mold themselves within the tray recesses as shall be described subsequently. However, it should be readily apparent that the present invention is also well suited for freezing other types of fleshy food which are capable of limited deformation when compressed during compaction and freezing.

Figure 2:
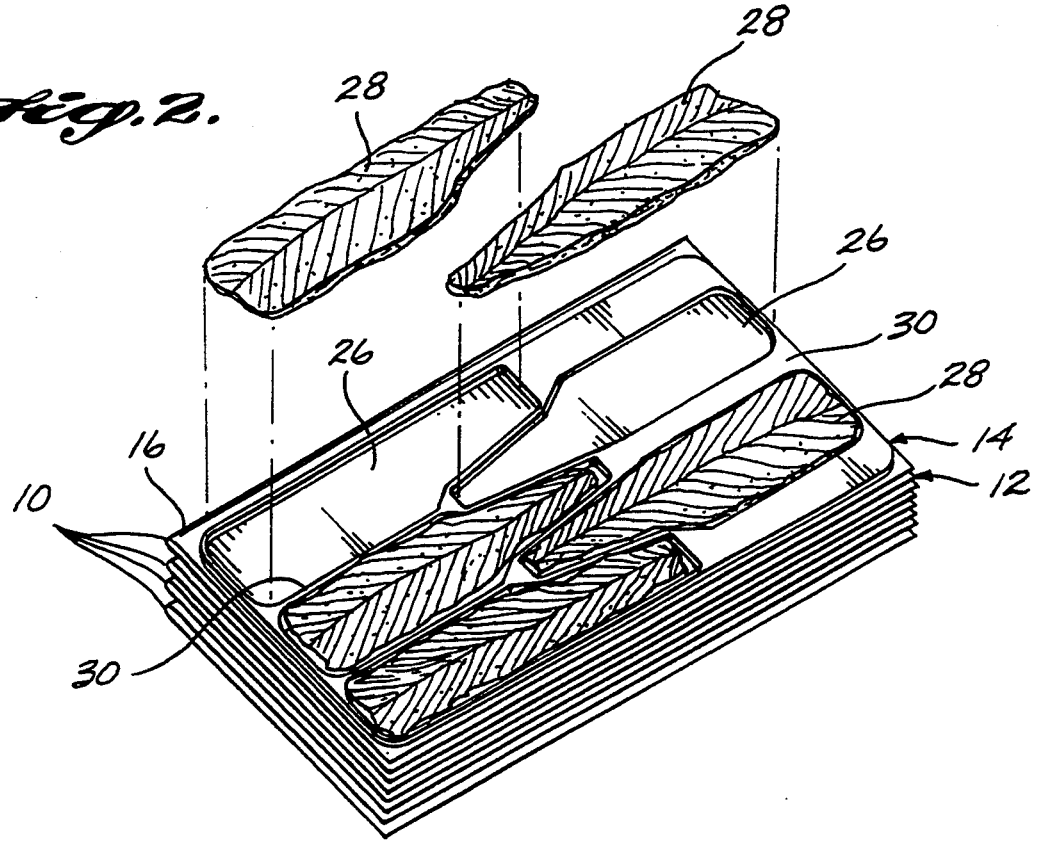
FIG. 2 is a pictorial view of a stack of trays constructed as in FIG. 1, and is shown with a top layer of fish fillets being arranged in the second portion of the uppermost folded tray.

FIG. 2 shows a stack of trays 10, prior to compaction within a carton, containing layers of fish fillets 28. As shall be described subsequently in greater detail, one fillet 28 is placed within each first recess 24 (not shown in FIG. 2) of the first portion 12 of a tray 10. The tray 10 is then folded along the hinge 16 so that second portion 14 overlies the first portion 12. Additional fillets 28 are then placed in the second recesses 26 formed in the second portion 14 of the tray 10, as shown in FIG. 2. The recesses 24 and 26 are configured to generally resemble the perimeter shape of fillets, but are larger than the fillets to accommodate a variety of sizes of fillets and to allow movement of the fillets within the recesses during compaction of the layers. Each filled tray 10 supports two layers of fillets 28.

Referring to FIG. 1, the first recesses 24 formed in the first portion 12 of the tray are separated by median strips 30. Similarly, referring to FIG. 2, the second recesses 26 formed in the second portion 12 are also separated by median strips 30. The width of the median strips 30 is narrow relative to the width of the first and second recesses 24 and 26. Thus when the fillets 28 are received within the first and second recesses 24 and 26, the individual fillets are prevented from contacting each other by the median strips 30, being maintained separate and apart from each other.

Reference is now made to FIGS. 3, 4 and 5 to better describe the construction and configuration of the first and second recesses 24 and 26 within the tray 10. FIG. 3 provides a plan view of the upper surface 20 of an unfolded tray 10. The sheet 18 has a first edge 32 disposed perpendicularly to the hinge portion 16 and an opposing parallel second edge 34 disposed parallel to the first edge 32. Referring to the first portion 12 of the tray 10, the preferred embodiment illustrated includes five first recesses 24. The recesses 24 are arranged as an even set of two recesses **24*a* adjacent the first edge 32 and an odd set of three recesses 24*b* disposed adjacent the second edge 34. Thus the pattern formed by the first recesses 24 is asymmetric with reference to a line midway between and parallel to the first and second edges 32 and 34. The longitudinal axes 36*a* and 36*b* of the recesses 24*a* and 24*b*, respectively, are oriented parallel to each other and perpendicular to the first and second edges 32 and 34**.

Each recess 24 has a generally planar bottom surface 38 surrounded by two elongate sidewalls 40, a wide endwall 42 and a narrow endwall 44. The wide endwalls 42 of the even set of first recesses **24*a* are disposed proximate the first edge 32 of the sheet 18. The wide endwalls 42 of the odd set of recesses 24*b* are disposed proximate the second edge 34. The recesses 24*a* and 24*b* are approximately equal in length, and are each longer than one-half the length of the sheet 18, as measured between the first and second edges 32 and 34. The even set of recesses 24*a* are therefore interposed alternately with the odd set of recesses 24*b*, as shown in FIG. 3, to closely pack the recesses. Specifically, the even and odd sets of recesses 24*a* and 24*b* are interposed between each other for approximately one-third of their lengths. To accommodate this placement, the interposed portion of each recess is tapered in width proximate the narrow endwall 44. The sidewalls 40 between adjacent recesses 24 cooperate to form the median strips 30**.

In the preferred embodiment illustrated, each of the recesses **24*a* and 24*b*** is of substantially the same depth, length and overall width. As one example of a suitable size, the recesses may be approximately one-quarter inch deep, approximately eleven inches long, and approximately three inches wide. These dimensions are provided solely for illustrative purposes, and may be substantially greater or smaller as required to accommodate differing sizes of seafood pieces. The exemplary dimensions stated above are suitable for processing pollock fillets weighing from two to six ounces each. The recesses would be sized somewhat larger for cod fillets or other large fish.

The longitudinal axes **36*a* of the even set of recesses 24*a* are spaced apart by an amount greater than the amount by which the longitudinal axis 36*b* of the odd set of recesses 24*b* is spaced apart. Thus the median strip 30 formed between the even set of recesses 24*a* is wider than the median strips 30 formed between the odd set of recesses 24*b*. The significance of the spreading of the axes of the even set of recesses 24*a* relative to the odd set 24*b*** is more fully described subsequently.

In the illustrated preferred embodiment 10 of FIGS. 1 through 5, five first recesses 24 are shown arranged in an alternating pattern of two recesses **24*a* and three recesses 24*b***. This number and arrangement of recesses has been found suitable for use with standard paperboard cartons in which fish are frozen using conventional plate freezer processing. Thus the present invention may be easily adapted to work with conventional equipment and supplies. However, this arrangement and number of recesses is provided solely for illustrative purposes, and it should be readily apparent that other arrangements and numbers of recesses may be utilized with the current invention. For example, a tray could be formed having six noninterposed, nonalternating recesses formed therein, with three recesses disposed along each edge of the tray. Alternately, a tray could be formed with nine recesses in an alternating pattern of an even set of four recesses interposed with an odd set of five recesses. Numerous other patterns within the scope of the present invention may be readily imagined.

Referring to FIGS. 1 and 3, the second recesses 26 are constructed and configured similarly to the first recesses 24. However, the second recesses 26 are the negative of the first recesses 24, as described previously. Further, the second recesses are arranged in an inverse pattern relative to the pattern of the first recesses, being rotated in disposition 180° on the second portion 14 relative to the first recesses 24 on the first portion 12. Thus, an even set **26*a* of the second recesses 26 is disposed adjacent the second edge 34 of the sheet 18, and an odd set 26*b* is disposed adjacent the first edge 32. In all other respects, the second recesses 26 are constructed and arranged identically to the first recesses 24**.

As was described previously, the second portion 14 of the tray 10 can be folded to overlie the first portion 12. The hinge portion 16 has sufficient width to enable the folded second portion 14 to be positioned generally parallel to the first portion 12 when fillets 28 are received within the first recesses 24. When folded in this fashion, the even set of second recesses **26*a* overlies the odd set of first recesses 24*b*, while the odd set of second recesses 26*b* overlies the even set of first recesses 24*a*. In this position, the even set of second recesses 26*a* is disposed over the median strips 30 separating the odd set of first recesses 24*b*, and the odd set of second recesses 26*b* is disposed over the median strips 30 separating the even set of first recesses 24*a*. This configuration is advantageous since the fillets 28 tend to be thicker along their longitudinal centers. Thus the thickest portions of the fillets 28 received within the second portion 14 of the tray 10 are disposed above the valleys formed between the thickest portions of fillets 28 received in the underlying first portion 12 of the tray 10**. This construction allows close packing of the layers during compaction and freezing.

Although the preferred embodiment of a tray 10 has been illustrated as having a first portion 12 hingedly connected to a second portion 14, it should be readily apparent that a tray having only a single portion corresponding to the first portion 12 of the tray 10 could be constructed in accordance with the present invention. Additional non-folding, single trays identically configured to the first single tray would then be stacked above the first single tray in 180° alternating fashion to achieve the same packing advantage. The preferred embodiment of a folding tray 10 is somewhat less labor intensive to utilize, but either version could be suitably employed. Similarly, reverse-folded multiple trays including a plurality of alternating first and second portions could be constructed. The tray 10 preferably includes a rim 46 formed about the outer perimeter of sheet 18. The rim 46, shown in FIGS. 3–5, comprises a right-angled flange. The rim 46 functions to both stiffen the sheet 18 and provide a hand grip for a food preparer to grasp when carrying a filled or partially filled tray 10.

When multiple fillet filled trays 10 are stacked and compacted, the fillets tend to mold themselves to the shape of the overlying tray. Thus, for example, a fillet placed in one of the even sets of first recesses 24*a* of a tray 10 would be in intimate contact with the underside of a median strip 30 separating the overlying odd set of second recesses 26*b* of the tray. Under the force of compaction, the fillet would tend to deform to fill the underside of the median strip 30. To prevent the formation of unsightly sharp ridges on the fillets during the freezing process using the present invention, the recess 24 and 26 sidewalls 40, and median strips 30 formed thereby, are bevelled.

Referring to FIGS. 3 and 4, the sidewalls 40 of each recess 24*a*, 24*b*, 26*a*, and 26*b* are angled relative to the bottoms 38 of the recesses. The angle formed by each sidewall 40 and corresponding bottom 38 is preferably between 95° and 150°, and still more preferably between 105° and 115°, and most preferably about 110°. Angling of the sidewalls beyond 150° is not desired to prevent the fillets from "escaping" the recesses 24 and 26 by crossing over the medians 30 during compaction. The angled sidewalls result in bevelled median strips 30 being formed between recesses. When a fillet is pressed into the underside of an overlaying median strip 30, a rounded "spine" is molded onto the top of the fillet. This molding effect has a natural appearance, and is not believed to be displeasing to the consumer. The bevelling of the sidewalls also enables the frozen fillets to be readily released from the recesses 24 and 26 for cooking or other processing.

Figure 6:
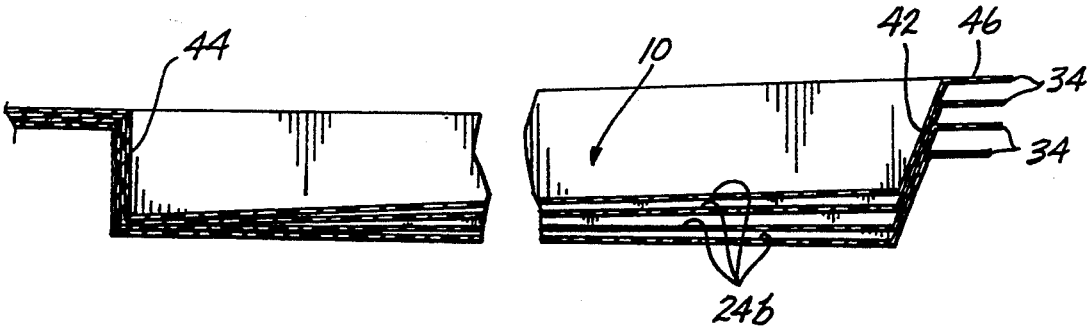
FIG. 6 is a partial cross-sectional view of a nested stack of empty trays, each constructed as in FIG. 3, taken through one recess of each tray substantially as indicated by arrow 6 in FIG. 3.

Reference is now had to FIGS. 3 and 6 to better describe an additional feature of the recesses 24 and 26. The wide endwall 42 or narrow endwall 44 of each recess 24 or 26 closest to the first edge 32 of the sheet 18 is disposed generally orthogonally to the bottom 38 of the recess. Thus, referring to the first portion 12, the wide endwalls 42 of the even set of recesses 24*a* and the narrow endwall 44 of the odd set of recesses 24*b* are disposed generally orthogonally to the corresponding bottoms 38. Similarly, the wide endwalls 42 of the odd set of second recesses 26*b* and narrow endwalls 44 of the even set of second recesses 26*a* within the second portion 14 are disposed orthogonally to the bottoms of those recesses.

The opposing endwall of each recess (i.e., the endwall closest to the second edge 34 of the sheet 18) is disposed at an obtuse angle with respect to the corresponding bottom of those recesses. Thus, the narrow endwalls 44 of the even set of first recesses 24*a*, and wide endwalls 42 of the odd set of first recesses 24*b*, are each disposed at an obtuse angle with respect to their corresponding bottoms 38. The narrow endwalls 44 of the odd set of second recesses 26*b* and wide endwalls 42 of the even set of second recesses 26*a* are obtusely angled. This obtuse angle is preferably at least 10°, and more preferably about 20°.

Empty trays 10 may be nested together, first portions overlaying first portions and second portions overlaying second portions, for shipment and storage prior to use in processing fish. The angling of the endwalls of the tray recesses facilitates separation of the individual trays from this nested stack. FIG. 6 shows a partial cross section view of stacked trays 10 taken along one recess from the odd set of first recesses 24*b* in the first portion 12 of each of the stacked trays. When the trays are nested atop each other, the orthogonal endwalls of each recess closely nest together, while the angled endwalls do not completely nest, and are instead spaced slightly apart. For example, as shown in FIG. 6, the narrow orthogonal endwalls 44 of each recess 24*b* are closely nested together. The longitudinal length of the base 38 of each recess 24*b* is the same, thus the opposing wide endwalls 42 interfere slightly with each other and do not nest as closely together. The obtuse angling of the wide endwalls 42 enables that end of the recesses 24*b* to partially nest, with the end of each recess 24*b* adjacent the angled endwall 42 biased and raised slightly above the underlying recess 24*b*. The even and odd sets of recesses 24 or 26 within each portion 12 or 14 of each tray 10 act in parallel to add a cumulative bias to the sheet 18, so that the portion of the peripheral rims 46 formed along the second edges 34 of the stacked trays 10 are spaced slightly apart. Thus, a person is able to grasp the separated portion of the rim 46 of the top tray 10 in the stack to facilitate removal of that top tray 10 from the stack of trays.

The tray 10 is formed from a thin sheet 18 of a flexible material which is capable of being deformed, or crushed, during compaction of fish received within the trays. The crushability of the tray 10 allows the recesses to be partially flattened and the tray to flex out of a generally planar overall initial configuration as required to accommodate the compacted fish fillets. However, the sheet 18 also must have sufficient strength and stiffness to prevent the fillets 28 from escaping across the median strips 30 during compaction. Suitable materials having the requisite strength and deformability include thermoplastic polymers, such as polystyrene or polyvinylchloride. However, other suitable crushable materials can be envisioned, such as thermoplastic rubbers. The thickness of the sheet is preferably less than 0.01 inches, and more preferably between 0.002 and 0.003 inches thick. Most preferably, food-grade polystyrene sheet of approximately 0.0025 inches in thickness has been found well suited for use in the present invention. The tray 10 may be constructed from a clear material, or alternatively may be constructed from a tinted material to stand out more readily from the fillets during later processing. Although tray 10 has been described as constructed from an integral sheet 18, it should be readily apparent that the tray could be constructed from separate first and second portions adhered to any of a variety of conventionally construed hinges.

METHOD OF PROCESSING SEAFOOD

Figure 7:
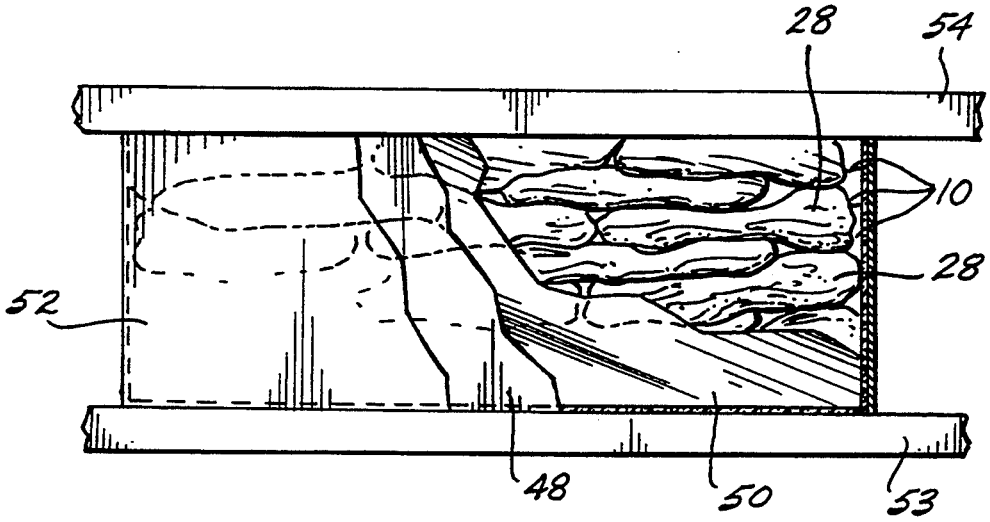
FIG. 7 is an end view of a paperboard carton filled with layers of fish fillets arranged on trays as shown in FIG. 2, compressed within a frame between shelves of a plate freezer, with a portion of the frame and paperboard carton removed to show compaction of the layers of fillets within the carton.

Reference is now had to FIGS. 2 and 7 to describe a method of processing seafood using trays constructed in accordance with the present invention to form a compacted stack of layers of separately frozen seafood pieces. FIGS. 2 and 7 illustrate a method using the preferred embodiment of foldable trays 10. FIG. 2 shows a noncompacted stack of fillets 28 layered within the first and second portions of folded trays 10. FIG. 7 illustrates such a stack of layered fillets on trays 10, contained within a cardboard or paperboard carton 48 for compaction and freezing within a plate freezer.

To layer the trays 10 and fish within a carton 48, an empty first portion 12 of a first tray 10 is first placed within a carton 48. The carton is preferably coated with paraffin wax or another suitable water impervious material, such as a film of plastic or foil 50. Individual fillets 28 are then placed within the first recesses 24. The fillets are preferably placed within the recesses with the thinner tail portion of each fillet disposed adjacent either edge 32 of 34 of sheet 18. The second portion 14 of the tray 10 is then folded into the carton on top of the first layer of fillets 28. A second layer of fillets 28 is then placed in an inverse pattern in the second recesses 26. Alternately, individual trays 10 can be filled and folded outside of the carton 48, followed by placement of the individual filled and folded trays 10, containing two layers of seafood, into the carton. This process is then repeated to build up a stack of layers of fillets. Standard industry cartons contain ten layers of fillets, with five fillets in each layer, thus utilizing five trays 10. However, it should be apparent that other quantities of fish may be stacked using the trays and method of the present invention. The same method can be followed using single, nonfoldable trays constructed in accordance with the present invention, in which ease the trays are placed in the carton in alternating fashion.

The method of the present invention is quicker than conventional shatter-pack processing, wherein fillets are arranged between sheets of plastic film, as a person does not need to think about how to arrange the fillets to achieve close packing. Instead, the arrangement is predetermined by virtue of the arrangement of the recesses and the rigidity of the tray. Additionally, the recesses in the tray prevent fillets from sliding into each other before freezing.

A paperboard top is then placed over the filled carton 48. Due to the loose packing of the fillets at this point in the process, the carton 48 is somewhat overfilled, and the top is not fully pushed down onto the carton 48. The carton 48 is then placed into a stiff vertical frame, such as a pan 52 shown in FIG. 7. Suitable pans 52 are aluminum pans used in conventional plate-freezing processes, although other stiff, heat-conductive material could be used. The pans 52 typically have both a bottom and sides, although a rectangular frame having only sides and no bottom could be utilized. The purpose of the frame is to contain the fillets 28 within the carton 48 during compaction, without splitting the sides of the carton 48.

The filled carton 48 within the pan 52 is then placed on a lower refrigerated shelf 53 of a conventional plate refrigeration unit. Typically, conventional plate refrigeration units accommodate a plurality of filled cartons positioned adjacent each other between sets of adjacent refrigerated shelves. An upper parallel refrigerated shelf 54 is then moved towards the lower shelf 53 to compress the layers of fillets and trays 10 within the carton 48. The movement of the shelves toward and away from each other is controlled by control circuitry. The extent of travel of the shelves toward each other is limited by the presence of the pans 52 and stop blocks, of approximately the same height as the pans 52, mounted between the shelves. When the shelves contact the stop blocks and pans, the carton tops have been fully installed onto the cartons, and the fillets within have been compressed and compacted.

As a result of the force of compaction, the trays 10 are crushed and flexed while still maintaining individual fillets 28 separate from each other within the recesses 24 and 26 in layers on top of each first and second portion 12 and 14 of each tray 10. The fillets 28 slide and deform within the recesses 24 and 26 under the force of compaction, but are prevented from leaving the recesses 24 and 26 by the median strips 30. The fillets 28 and trays 10 are thus deformed to fill substantially all large air pockets within the carton 48.

As previously described, the recesses 24 or 26 formed in each tray 10 are spaced relative to each other to a predetermined extent. The even sets **24*a* and 26*a* of recesses are spaced further apart from each other than the odd sets of recesses 24*b* and 26*b*. This spacing is to prevent fillets in each layer from slumping too far out of their layer into voids present on either side of the even set of recesses 24*a* or 26*a*** in the next tray below. Thus the layers are maintained in separable form.

The compacted layers within the cartons 48 are then frozen to form layers of individually frozen seafood pieces. The individual fillets 28 within each layer are substantially separate, although the outer edges of fillets can potentially contact each other if sufficient care is not taken in arranging the fillets within the recesses. However, this small extent of contact between fillets is not sufficient to prevent easy separation of the fillets from each other without breakage of the fillets.

After removal from the plate freezer, the frozen layered, individually separated fillets can be placed in a storage freezer within the cartons 48 until it is time for cooking or further processing. In order to remove a portion of the fillets from the stack of layers within the carton, it is not necessary to shatter or otherwise separate all of the layers, nor is it necessary to thaw the fillets within the layers. Rather, the top portion 12 or 14 of a tray 10 is simply grasped by the rim 46 and lifted upwardly to peel that portion of the tray, and the fillets contained within the recesses formed therein, away from and off of the remainder of the layers in the compacted stack. Thus no air is introduced between the remaining layers of the compacted stack. Similarly, individual fillets can be removed from the uppermost stack by lifting them out of the recesses without disturbing the remaining fillets in that layer.

Each fillet in the carton is layered on its bottom side by the recess in which it is contained, on its top side by the overlying tray portion, and on its edges by the median strips. Thus, each fillet is substantially encased by the trays, and is not dehydrated extensively by air. The fillet thus maintain freshness, approaching the benefit obtained by more costly and time-consuming individual glazing of frozen fillets.

The embodiments of the invention in which an exclusive property or privilege is claimed are defined as follows:

1. A foldable tray for receiving a plurality of seafood pieces in a layer for compaction and freezing with a stack of adjacent layers of seafood pieces, comprising:

a foldable sheet of material including a first portion formed to define a plurality of first recesses, each recess capable of receiving and substantially surrounding a piece of seafood to form a layer of individual separated seafood pieces;

a second portion defining a plurality of second recesses, wherein each second recess is capable of receiving and substantially surrounding a piece of seafood to form a second layer of individual separated seafood pieces, wherein said second recesses are oriented relative to said first recesses such that when said sheet is in an unfolded condition said second recesses are inverted relative to said first recesses; and a flexible hinge portion defined between the first portion and the second portion, the sheet being foldable along the hinge portion so that when the sheet is in an folded condition the second portion overlies and is substantially parallel to the first portion and the first and second recesses open in the same direction when said second portion overlies said first portion, the sheet being constructed and contoured to be deformable and to enable seafood pieces, when received in the first and second recesses, to deform within the first and second recesses under the force of compaction, to form first and second layers of substantially separate seafood pieces.

2. The tray of claim 1, wherein:

the first recesses are elongated and arranged in a pattern to form an even set disposed adjacent a first edge of the sheet and an odd set disposed adjacent an opposing second edge of the sheet, first recesses in the even set partially interposed between first recesses in the odd set; and the second recesses are elongated and arranged in an inverse pattern relative to the first recesses, to form an even set disposed adjacent the second edge of material sheet and an odd set disposed adjacent the first edge of the sheet, thereby facilitating compaction of the first and second layers of pieces when the sheet is folded.

3. The tray of claim 1, wherein:

the longitudinal axes of the first recesses in the even set are spaced apart by a distance greater than a distance at which the longitudinal axes of the first recesses in the odd set are spaced apart.

4. The tray of claim 1, wherein each of the first recesses in the even and odd sets includes a wide portion proximate the first or second edge, respectively, and a narrow portion, the narrow portions of the first recesses in the even and odd sets being at least partially interposed.

5. The tray of claim 1, wherein:

the first recesses each include a bottom and opposing elongated sidewalls, each sidewall defining an angle of at least 95° and no more than 150° relative to the bottom of the respective first recess; and the sidewalls of adjacent first recesses cooperate to form a median strip separating the adjacent first recesses.

6. The tray of claim 5, wherein:

the sidewalls of each first recess define an angle of from about 105° to about 115° relative to the bottom of the respective first recess.

7. The tray of claim 1, wherein:

the sheet is constructed to enable peeling of the sheet and the layer of frozen pieces received in the first recesses formed therein from a compacted stack of adjacent layers of frozen pieces.

8. The tray of claim 7, wherein the sheet is constructed from a thermoplastic material.

9. The tray of claim 8, wherein the sheet has a thickness of less than or equal to 0.01 inches.

10. The tray of claim 9, wherein the thickness of the sheet is from 0.002 to 0.003 inches.

11. The tray of claim 1, wherein the sheet further defines a rim formed around the outer perimeter of the sheet.

12. The tray of claim 1, wherein:

the first recesses are elongated and each include a bottom and first and second opposing endwalls, the first endwall of each first recess being formed substantially orthogonally relative to the bottom and the second endwall of each first recess being formed at an obtuse angle relative to the bottom and oriented toward an edge of the sheet, whereby the tray is nestable with a plurality of similarly configured trays when no seafood pieces are received therein, so that the edges of the trays adjacent the second endwalls are slightly separated.

* * * * *